US010919056B2

(12) United States Patent
Luo et al.

(10) Patent No.: US 10,919,056 B2
(45) Date of Patent: Feb. 16, 2021

(54) COMBINATION SHOWER

(71) Applicant: XIAMEN SOLEX HIGH-TECH INDUSTRIES CO., LTD., Fujian (CN)

(72) Inventors: Weilong Luo, Fujian (CN); Donghai Chen, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 75 days.

(21) Appl. No.: 16/025,670

(22) Filed: Jul. 2, 2018

(65) Prior Publication Data

US 2019/0054479 A1 Feb. 21, 2019

(30) Foreign Application Priority Data

Aug. 21, 2017 (CN) ..... 201710718093.5

(51) Int. Cl.

| | |
|---|---|
| ***B05B 1/16*** | (2006.01) |
| ***E03C 1/04*** | (2006.01) |
| ***B05B 1/18*** | (2006.01) |
| ***B05B 12/00*** | (2018.01) |

(Continued)

(52) U.S. Cl.

CPC ..... *B05B 1/16* (2013.01); *B05B 1/1636* (2013.01); *B05B 1/18* (2013.01); *B05B 12/002* (2013.01); *E03C 1/023* (2013.01); *E03C 1/0408* (2013.01); *E03C 1/0409* (2013.01); *B05B 1/185* (2013.01); *B05B 15/62* (2018.02); *E03C 1/0405* (2013.01); *E03C 2001/0414* (2013.01)

(58) Field of Classification Search

CPC ..... B05B 1/16; B05B 1/185; B05B 1/1627; B05B 1/1636; B05B 1/1609; B05B 1/1618; B05B 1/1681; B05B 1/18; B05B 15/62; B05B 15/65; B05B 12/002; E03C 1/0405; E03C 2001/0414; E03C 1/023; E03C 1/0408; E03C 1/0409

USPC ..... 4/601, 605

See application file for complete search history.

(56) References Cited

U.S. PATENT DOCUMENTS 8,096,488 B2 * 1/2012 Mueller ..... B05B 1/1663 239/289

8,919,379 B2 * 12/2014 Zhou ..... E03C 1/0408 137/625.48

(Continued)

*Primary Examiner* — Qingzhang Zhou

*Assistant Examiner* — Christopher R Dandridge

(74) *Attorney, Agent, or Firm* — Cooper Legal Group, LLC

(57) ABSTRACT

A combination shower includes: a head shower and a hand-held shower; the head shower has a connecting component that forms a removable fit with the hand-held shower. it also includes a water sealing component and a trigger component which are linked to each other, and the water sealing component is set in the head shower waterway; when the hand-held shower is separated from the head shower, the sealing component is in the first position in the head shower waterway, so that the flow volume of the head shower waterway is smaller or closed; when the hand-held shower is connected with the connecting component, the trigger component is driven by external force to drive the sealing component to move to the second position in the head shower waterway, so that the flow volume of the head shower waterway is enlarged or opened.

9 Claims, 11 Drawing Sheets

(51) Int. Cl.
*E03C 1/02* (2006.01)
*B05B 15/62* (2018.01)

(56) References Cited

U.S. PATENT DOCUMENTS 9,149,817 B2 * 10/2015 Lev ..... E03C 1/0409
2009/0007330 A1 * 1/2009 Genord ..... B05B 15/62
4/695

* cited by examiner

COMBINATION SHOWER

TECHNICAL FIELD

The invention relates to a water outlet device, and more particularly to a kind of shower.

BACKGROUND TECHNOLOGY

The combination shower is very common in the family bathroom nowadays. The traditional combination showers have head shower and hand-held shower, and the two showers are controlled by one switch. Switch one of the two shower by switch to make water out. Therefore, The switching of the waterway is a passive process, and the head shower can not be automatically opened and closed by taking on or off the hand-held shower. In addition, with the change of the appearance of the shower, there is a nested set of head shower and hand-held shower. If the user is using the head shower, only the head shower is running out of water. Because the water outlet surface of the head shower is annular, the water outlet area is relatively small. when only the head shower is running out of water, the shower experience is rather poor.

SUMMARY OF THE INVENTION

The main technical problem to be solved by the invention is to provide a combination shower. When the user needs to use hand-held shower to shower, the head shower automatically stops the water. In order to solve the above technical problems, the present invention provides a combination shower, including: a head shower and a hand-held shower; the head shower has a connecting component that forms a removable fit with the hand-held shower.

It also includes a water sealing component and a trigger component which are linked to each other, and the water sealing component is set in the water outlet of the head shower waterway; when the hand-held shower is separated from the head shower, the sealing component is in the first position in the head shower waterway, so that the flow volume of the head shower waterway is smaller or closed; when the hand-held shower is connected with the connecting component, the trigger component is driven by external force to drive the sealing component to move to the second position in the head shower waterway, so that the flow volume of the head shower waterway is enlarged or opened.

In a preferred embodiment: when the head shower and the hand-held shower are connected, the abutting force generated by the hand shower and the trigger component abutting each other drives the trigger component and the sealing water component to move together.

In a preferred embodiment: the head shower includes a water outlet component and a water inlet component; the water inlet component includes the head shower waterway and the hand-held shower waterway; the hand-held shower waterway is connected to the hand-held shower through a water outlet hose.

In a preferred embodiment: the trigger component and water sealing components are two different sectionts of one integral component; or the trigger component and water sealing component are two independent components, the trigger component and the water sealing component are connected to form an interlocking connection.

In a preferred embodiment: the trigger component is a swinging block swingably connected to the water inlet component; the water inlet component has a concession opening, and one end of the swinging block is exposed to the side of the water inlet component facing the hand-held shower through the concession opening.

In a preferred embodiment: the swinging block comprises a swinging rod and a wedge block, and one end of the swinging rod is swingably disposed in the water inlet component through a rotating shaft; the wedge block is set at the other end of the swinging rod and exposed to the side of the water inlet component facing hand-held shower through the concession opening;

the water sealing component include a moving shaft and a sealing ring arranged outside the moving shaft; one end of the moving shaft abuts on the swinging rod;

when the hand-held shower is connected with the connecting component, the force generated by the contact of the back of the hand-held shower with the wedge block causes the swinging rod to swing; the abutting force between the swinging rod and the moving shaft causes the moving shaft moves to the second position along its own axis.

In a preferred embodiment: the other end of the moving shaft is connected with a reset component; when the moving shaft is moved to the second position, the reset component accumulates an elastic reset force.

In a preferred embodiment: in the head shower waterway there is a concession section which the inner diameter is larger than the outer diameter of the sealing ring; when the moving shaft is located at the second position, the sealing ring is moved into the concession section, and the sealing ring is separated from the inner wall of the head shower; when the moving shaft is located in the first position, the sealing ring leaves the concession section, and the sealing ring is sealed with the inner wall of the head shower waterway.

In a preferred embodiment: the connecting component are two clamping blocks arranged oppositely on the side of the water inlet component facing the hand-held shower; a clamping space for holding the hand-held shower is formed between the two clamping blocks, the wedge blocks are exposed between two clamping blocks.

In a preferred embodiment: the water inlet component also includes a second head shower waterway which is kept normally open and a gear selection component; one end of the gear selection component is a sealing component and the other end is an operating component;

when the gear selection component is located in the first gear position, the sealing component is separated from the water inlet of the second head shower waterway, and the second head shower waterway is always communicated with the water inlet end of the water inlet component;

the gear selection component is located in the second gear position, the sealing component is sealed with the water inlet of the second head shower water, the second head shower waterway and the water inlet end of the water inlet component are isolated and sealed.

In a preferred embodiment: when the gear selection is at the first or second gear position, the hand-held shower water always communicated with the water inlet end of the water inlet component.

Compared with the existing technology, the technical solution of the present invention has the following beneficial effects:

1. The invention provides a combination shower, when the hand-held shower and head shower are used together, the head shower and the hand-held shower are used to discharge water respectively and increase the shower area. When the user separates the hand-held shower from the head shower, the head shower is automatically stopped, the water only run out from the hand-held shower. It fits users' habits perfectly, and these processes are automatically completed when users pick up or off the hand-held shower, and it do not need extra operation by users. It's very convenient.

2. The invention provides a combination shower, and by installing the hand-held shower, the hand-held shower exerts a abutting force on the swinging block to make the swinging block to move the water sealing component, so as to achieve to open the head shower waterway. And as long as the hand-held shower is kept in the installed state, the abutting force between the hand-held shower and the swinging block is always present, so that the water sealing component can be always kept in an open state, so that the head shower discharge water normally and increases the shower area, the function is stable and reliable.

3. The present invention provides a combination shower, a second head shower waterway and a gear selection component are additionally arranged in water outlet component. The gear selection component can control whether the second head shower waterway is connected to the water inlet end of the water outlet component. If the second head shower waterway is connected to the water inlet end of the water outlet component, because the second head shower waterway always remains open, whether the hand-held shower is hanging or leaving the held shower, the head shower can discharge water normally. If the second head shower waterway is not connected to the inlet end of the water outlet component, then only when the hand-held shower is hanging, the head shower can normally discharge water. The gear selection component gives the user more options.

DETAILED DESCRIPTION

Figure 1:
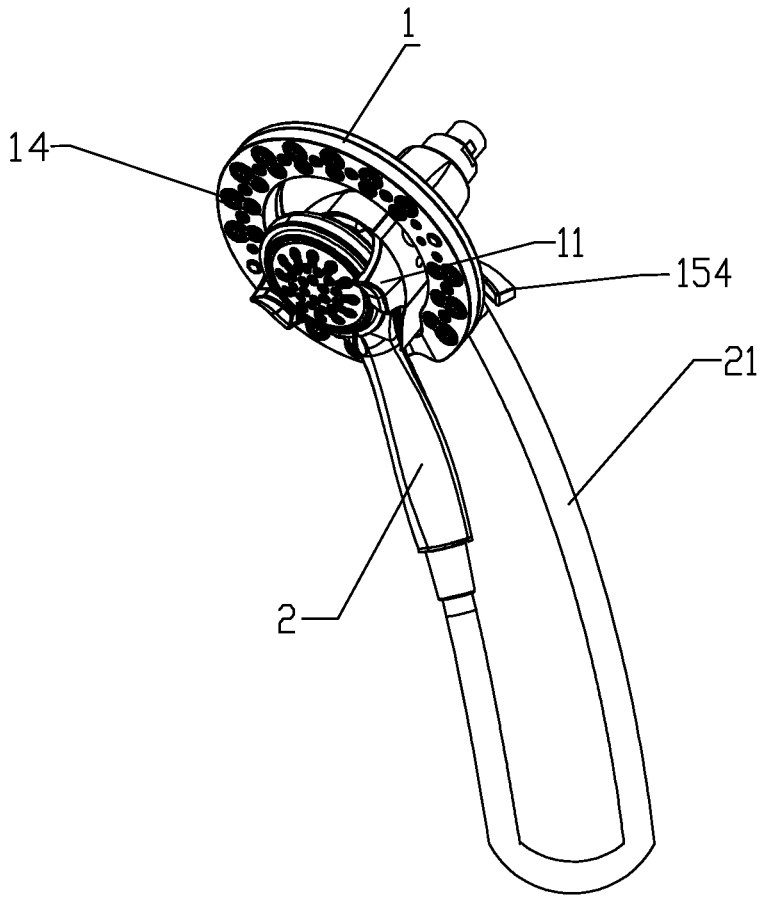
FIG. 1 is a combined schematic diagram of combination shower in the preferred embodiment 1 of the present invention.
Figure 2:
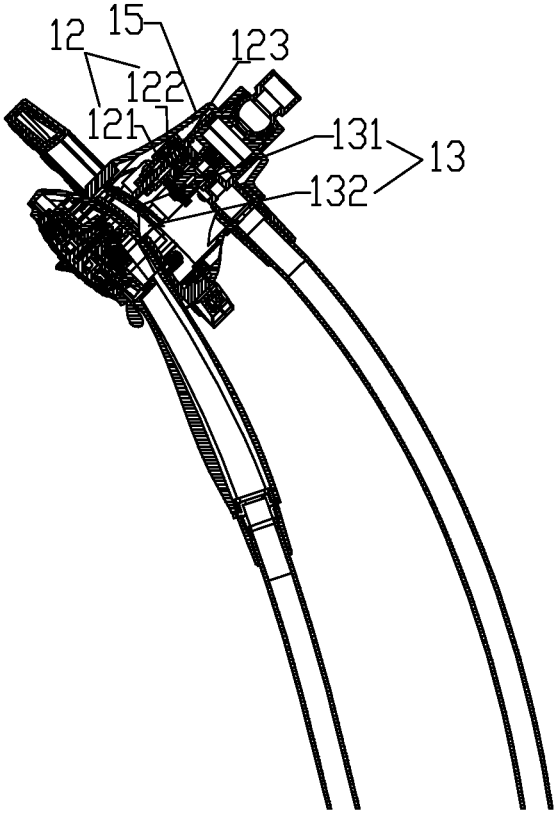
FIG. 2 is a structural profile of the combination shower in the preferred embodiment 1 of the present invention.
Figure 3:
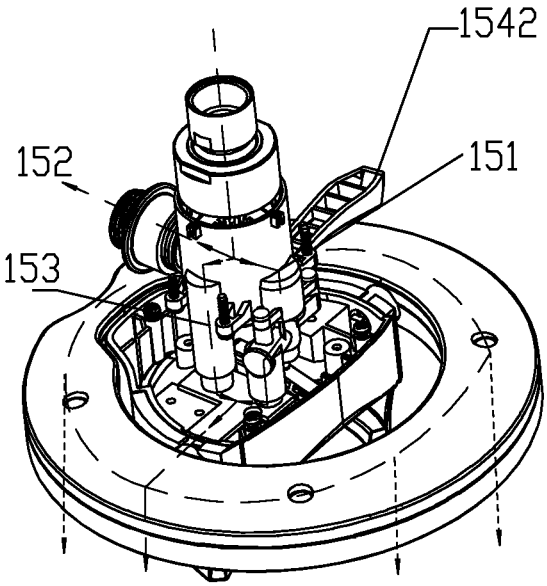
FIG. 3 is a waterway diagram of the water outlet component in the preferred embodiment 1 of the present invention.
Figure 4:
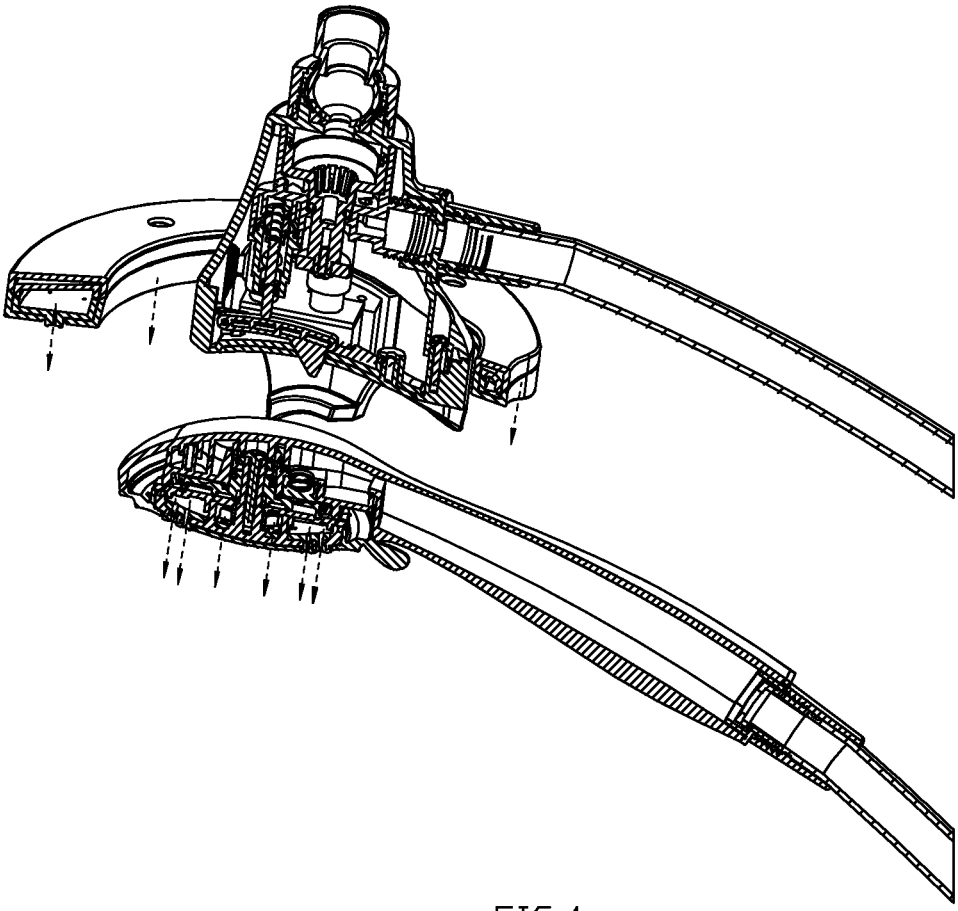
FIG. 4 is a schematic diagram of the combination shower of the preferred embodiment 1 of the present invention, when the combination shower is in the first gear position, the hand-held shower and the head shower is separated.
Figure 5:
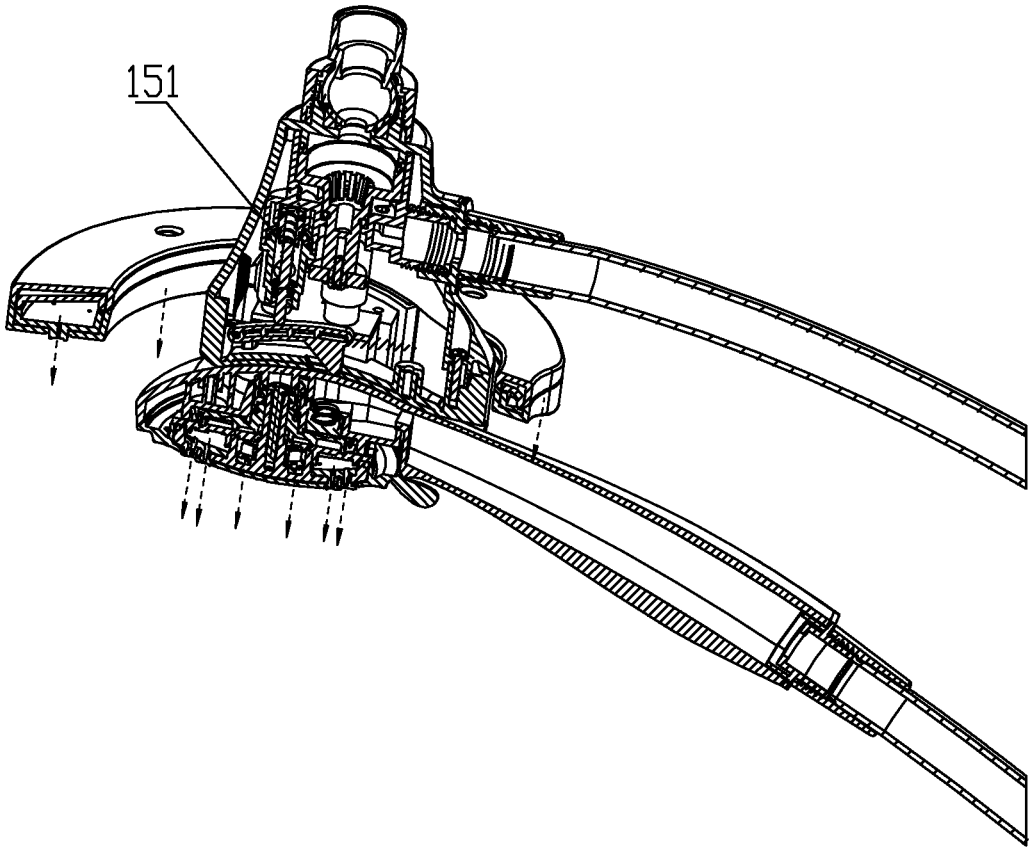
FIG. 5 is a schematic diagram of the combination shower of the preferred embodiment 1 of the present invention, when the combination shower is in the first gear position, the hand-held shower and the head shower is combined.
Figure 6:
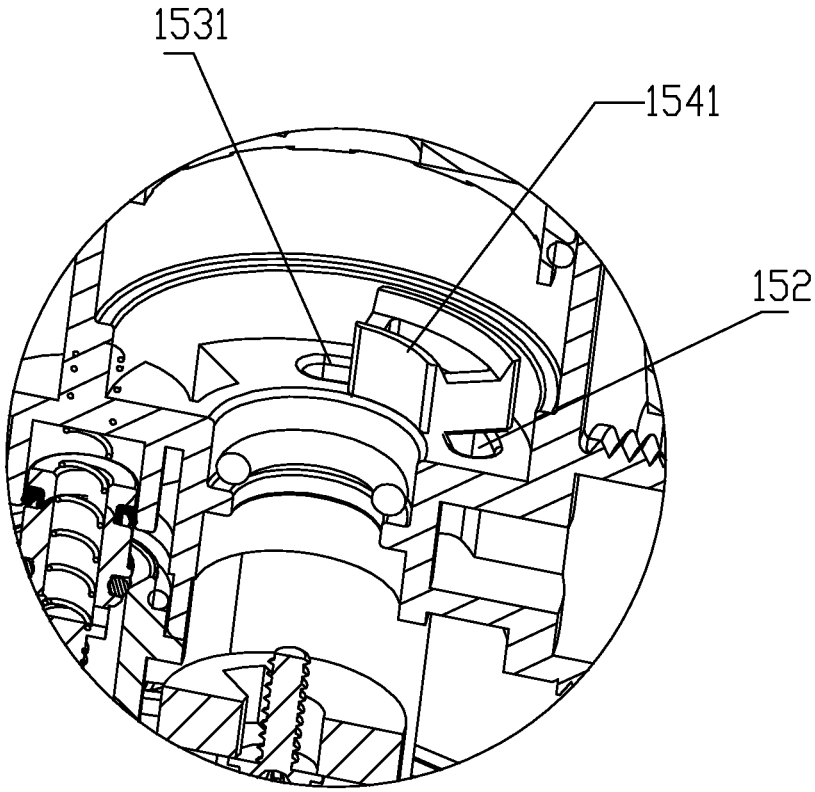
FIG. 6 shows the position of the sealing end of the gear selection component in the state of FIG. 4 and FIG. 5.
Figure 7:
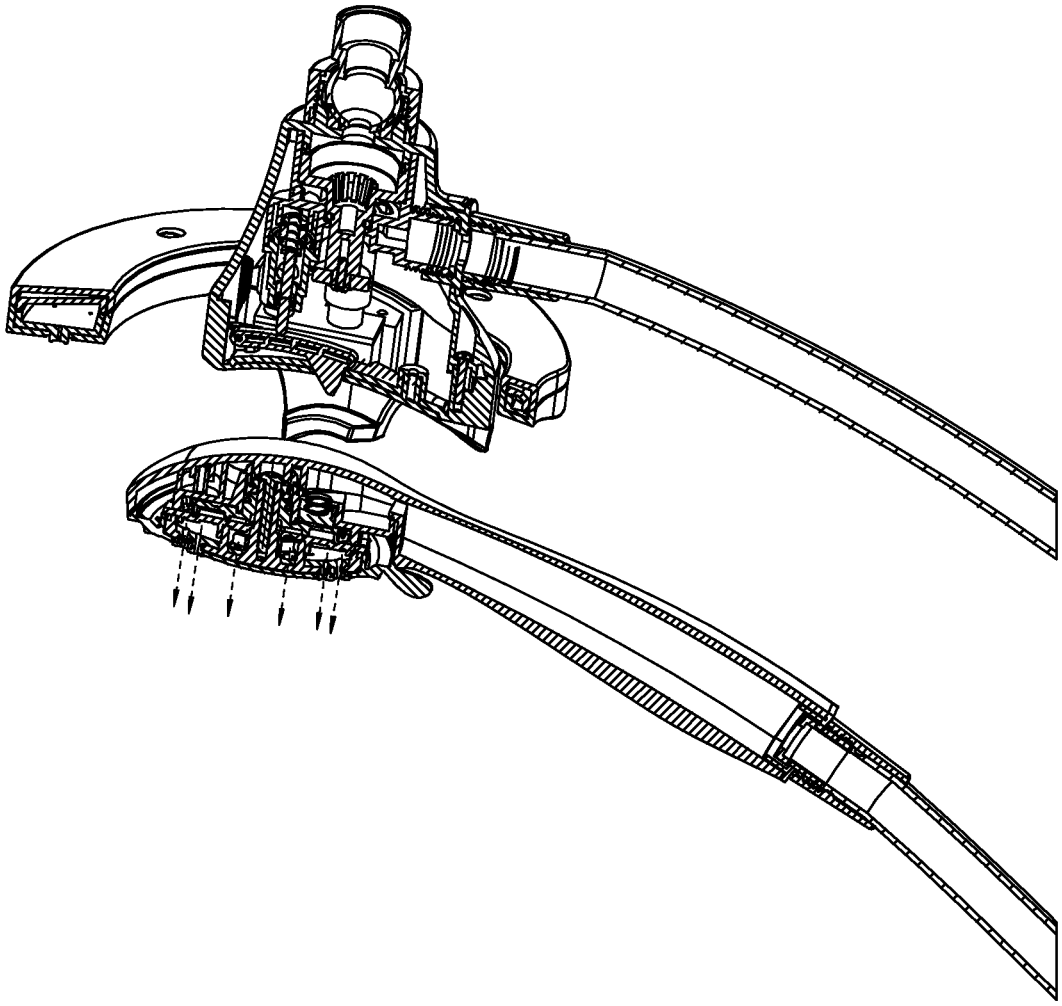
FIG. 7 is a schematic diagram of the combination shower of the preferred embodiment 1 of the present invention, when the combination shower is in the second gear position, the hand-held shower and the head shower is separated.
Figure 8:
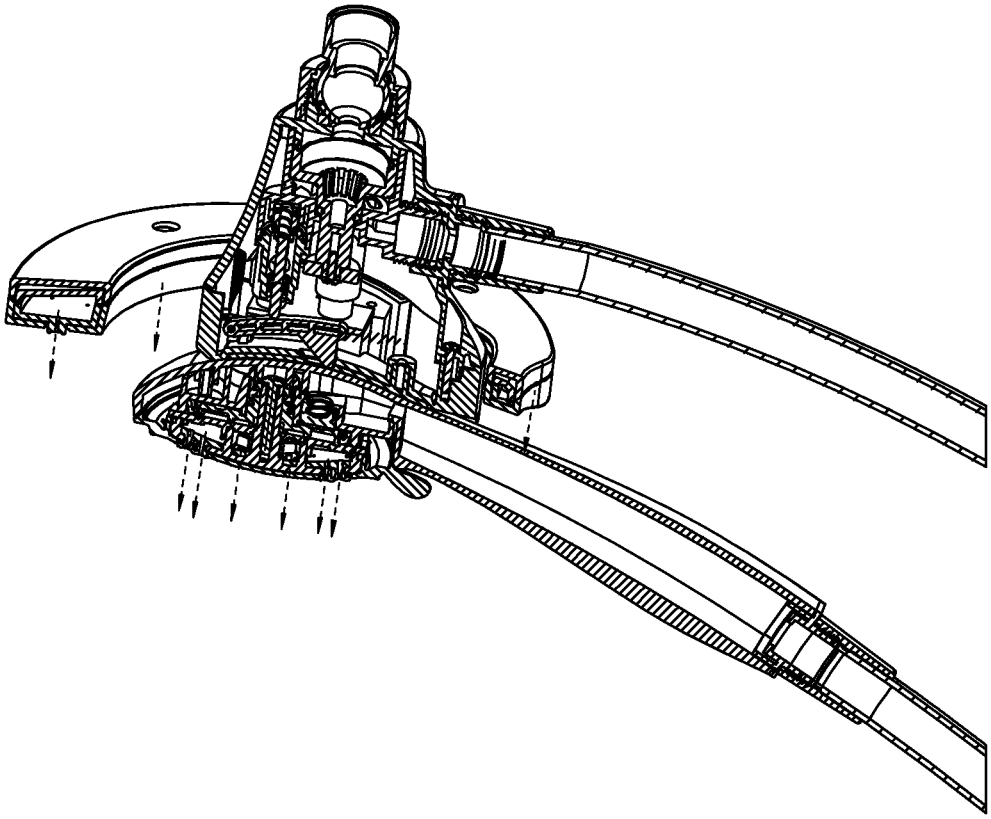
FIG. 8 is a schematic diagram of the combination shower of the preferred embodiment 1 of the present invention, when the combination shower is in the second gear position, the hand-held shower and the head shower is combined.
Figure 9:
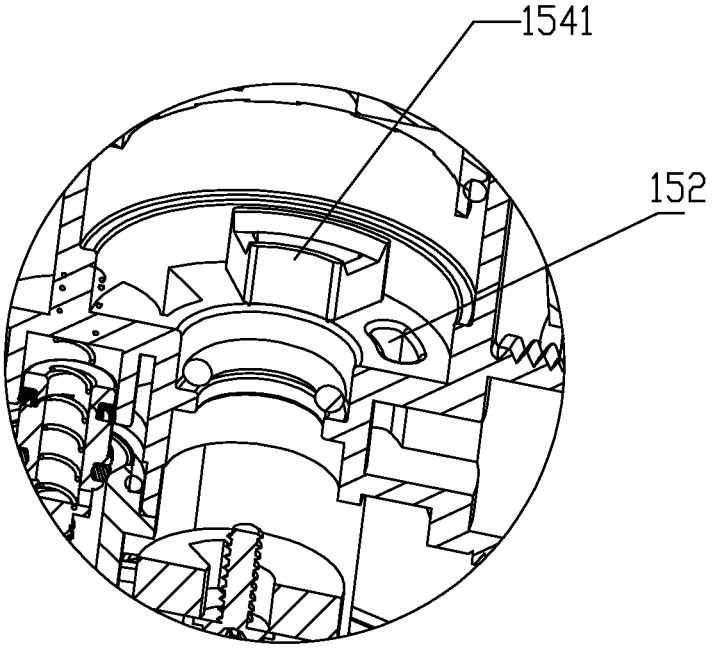
FIG. 9 shows the position of the seal end of the gear selection component in the state of FIG. 7 and FIG. 8.

The technical solutions of the present invention are further described with reference to the accompanying drawings and the embodiments below.

Embodiment 1

Refer to FIG. 1-9, a combination shower, including: a head shower 1 and hand-held shower 2; the head shower 1 has a connecting component 11 that forms a removable fit with the hand-held shower 2.

It also includes a water sealing component 12 and a trigger component 13 which are linked to each other, and the water sealing component 12 is set in the first head shower waterway 151, and the first head shower waterway 151 has a first position and a second position; when the hand-held shower 2 is separated from the head shower 1, the sealing component 12 is in the first position, so that the flow volume of the head shower waterway 1 is smaller or closed; when the hand-held shower 2 is connected with the connecting component 11, the trigger component 13 is driven by external force to drive the sealing component 12 to move to the second position in the first head shower waterway 151, so that the flow volume of the head shower waterway 1 is enlarged or opened.

Therefore, the above combination shower, when the hand-held shower 2 and the head shower 1 are used together, the head shower 1 and the hand-held shower 2 discharge water respectively and increase shower area. When the user separates the hand-held shower 2 from the head shower 1, the head shower 1 automatically stops the water or discharge very little water. The flow of very little water is not for showers, it is only to reduce the water pressure inside the head shower 1 and prevent the head shower 1 from being damaged by water pressure. Only the hand-held shower 2 discharge water. The user's habits are perfectly fitted, and the process of these water switching is automatically completed with the user taking on or off the hand-held shower 2, without extra operation, which is very convenient.

In this embodiment, in order to realize the accurate triggering of trigger component 13, when the head shower 1 and the hand-held shower 2 are connected, the abutting force generated by the hand shower 2 and the trigger component 13 abutting each other drives the trigger component 13 and the sealing water component 12 to move together. In this way, the abutting force of the hand-held shower 2 on the trigger 13 enables the trigger component 13 to drive the sealing water component 12 to move by installing the hand-held shower 2, so as to realize the opening of the first head shower waterway 151. And as long as the hand-held shower 2 is in the installation state, the abutting force between the hand shower 2 and the trigger component 13 is always present, so the water sealing component 12 can be kept in the open state, the the head shower can discharge water normally, shower area is increased, the function is reliable and stable.

The concrete structure of the present embodiment is as follows: The head shower 1 includes a water outlet component 14 and a water inlet component 15, and the water outlet component 14 in the present embodiment is circular; the water inlet component 15 includes the first head shower waterway 151 and the hand-held shower waterway 152; the hand-held shower waterway 152 is connected to the hand-held shower 2 by the water hose 21.

In the present embodiment, the trigger component 13 is swinging block connected to the water inlet component 15; the water inlet component 15 has a concession opening, and one end of the swinging block is exposed to the side of the water inlet component 15 facing the hand-held shower 2 through the concession opening. Specifically, the swinging block includes a swinging rod 131 and a wedge block 132, and one end of the swinging rod 131 is swingably disposed in the water inlet component 15 through a rotating shaft; the wedge block 132 is set at the other end of the swinging rod 131 and exposed to the side of the water inlet component 15 facing the hand-held shower 2 through the concession opening.

The water sealing component 12 includes a moving shaft 121 and a sealing ring 122 arranged outside the moving shaft 121; one end of the moving shaft 121 abuts the swinging rod 131.

When the hand-held shower 2 is connected with the connecting component 11, the abutting force between the back of the hand-held shower 2 and the wedge block 132 makes the swinging rod 131 swing; the abutting force between the swinging rod 131 and the moving shaft 121 causes the moving axis 121 to move to the second position along its own axis. In this way, the whole trigger process is realized.

In addition, in order to achieve that when the hand-held shower 2 removed, the sealing component 12 can automatically return to the first position from the second position. In the embodiment, the other end of the moving shaft 121 is connected with a reset component 123. When the moving shaft 121 moves to the second position, the reset component 123 accumulates an elastic reset force. So when the hand-held shower 2 is removed, the abutting force between the hand-held shower 2 and the wedge block 132 will disappear, and the moving shaft 121 will reset to the first position under the action of the reset force of the reset component 123. Therefore, when the hand-held shower 2 is taken down, the head shower 1 automatically closes the water.

In the present embodiment, the sealing principle of the sealing ring 122 is described as follows: the first head shower waterway 151 has a concession section, and its inner diameter larger than the outer diameter of the sealing ring 122. When the moving shaft 121 is located at the second position, the sealing ring 122 is moved into the concession section, and the sealing ring 122 is separated from the inner wall of the first head shower 151. When the moving shaft 121 is located in the first position, the sealing ring 122 leaves the concession section, and the sealing ring 122 seals the inner wall of the first head shower waterway 151.

Finally, the connecting component 11 is two clamping blocks arranged oppositely on the side of the water inlet component 15 facing the hand-held shower. Between the two clamping blocks, a clamping space clamping the hand-held shower 2 is formed, and the wedge block 132 is exposed between the two clamping blocks. In this way, when the hand-held shower 2 is clamped by two clamping blocks, the back of the hand-held shower 2 must abut the wedge block 132. The functions of discharging water and switching of the whole shower are stable.

In this embodiment, the wedge block 132 is corresponding to the back central region position of the hand-held shower, and according to the needs, the wedge block block 132 can also be arranged in the other position, so that it can abut the other part of the hand-held shower 2, as long as when the hand-held shower 2 and the head shower 1 is installed, the abutting of the hand-held shower 2 and wedge block 132 can achieve the purpose of the present invention, the embodiment is just to illustrate, should not be used to limit the scope of the invention.

In the above structure, the water outlet mode of the combination shower is fixed. 1. at the time of the hand-held is suspended, the head shower and the hand-held shower discharge water at the same time. 2. When the hand-held shower is taken down, the head shower does not discharge water, the hand-held shower discharge water only. In the actual use of the process, some consumers hope that the head shower and hand-held shower discharge water at same time when they remove the hand-held shower, for example, when adults and children are showering together. At this time, the combination shower of the above structure can not meet the needs of the consumer. In order to solve this problem, in the present embodiment:

The water inlet component 15 also includes a second head shower waterway 153 which keep opening, and a gear selection component 154; one end of the gear selection component 154 is a seal component 1541, and the other end is the operation component 1542. The user can drive the operation component 1542 to move the seal component 1541.

When the gear selection component 154 is in the first gear, the seal component 1541 is separated from the water inlet 1531 of the second head shower waterway 153, and the second head shower waterway 153 is communicated with the water inlet of the water inlet component 15. At this time, whether the hand-held shower 2 is hanging or leaving the head shower 1, the head shower 1 can normally discharge water, and the water flow from the second head shower waterway 153 into the water outlet component 14.

When the gear selection component 154 is in the second gear, the sealing component 1541 is closed and seals the water inlet 1531 of the second head shower waterway 143, and the second head shower waterway 153 is sealed from the water inlet of the water inlet component 15. The sealing component 1541 comprises a sealing ring. At this time, the water outlet mode of the combination shower is changed: 1. when the hand-held shower 2 is hanging on the head shower 1, the head shower 1 and the hand-held shower 2 discharge water at the same time; and 2. when the hand-held 2 is taken down, the head shower 1 does not discharge water, and only the hand-held shower 2 discharges water. The gear selection component 154 gives the user more choice, which broadens the applicable crowd.

In addition, whether the gear selection component 154 is in the first or the second gear, the hand-held shower waterway 152 always communicated with the water inlet of the water inlet component 15. So no matter how to move the operation component 1542, the hand-held shower 2 of the water will not be affected.

Embodiment 2

Figure 10:
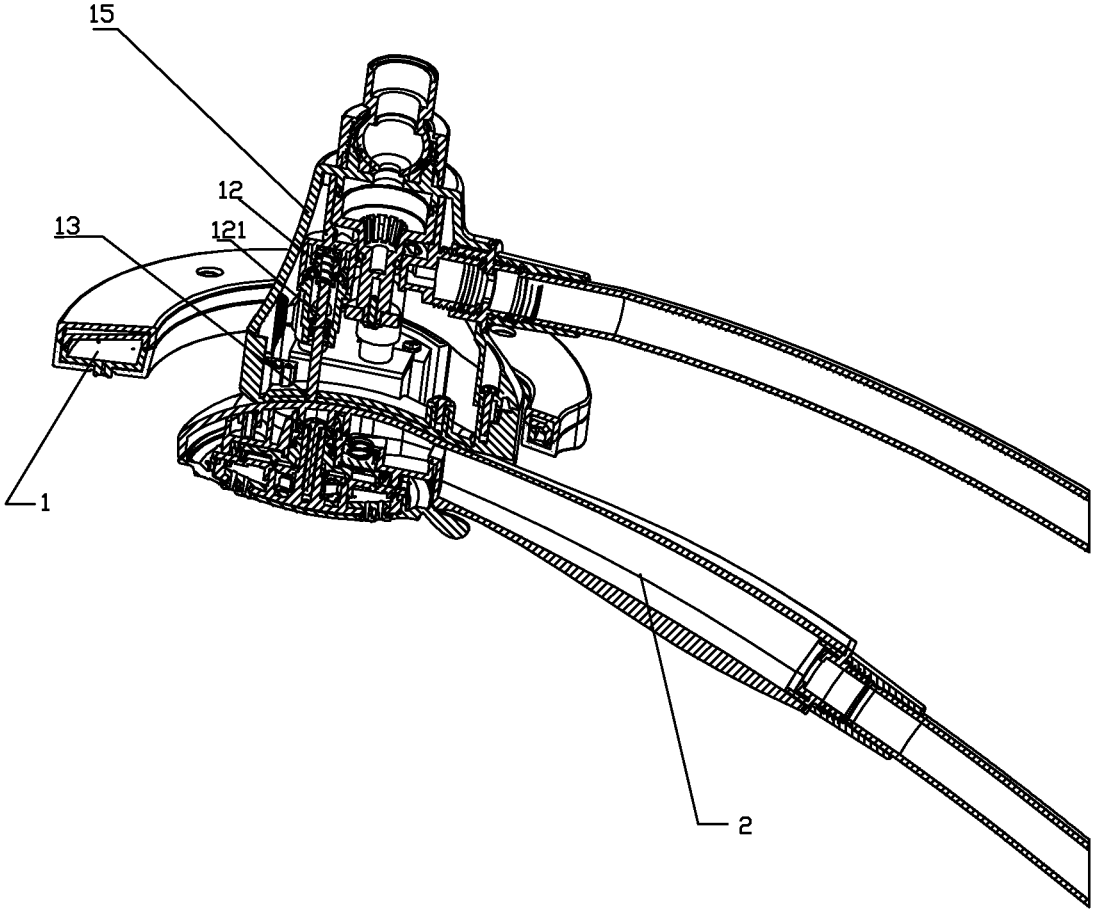
FIG. 10 is a structural profile of the combination shower in the preferred embodiment 2 of the present invention. when the hand-held shower and the head shower is combined.
Figure 11:
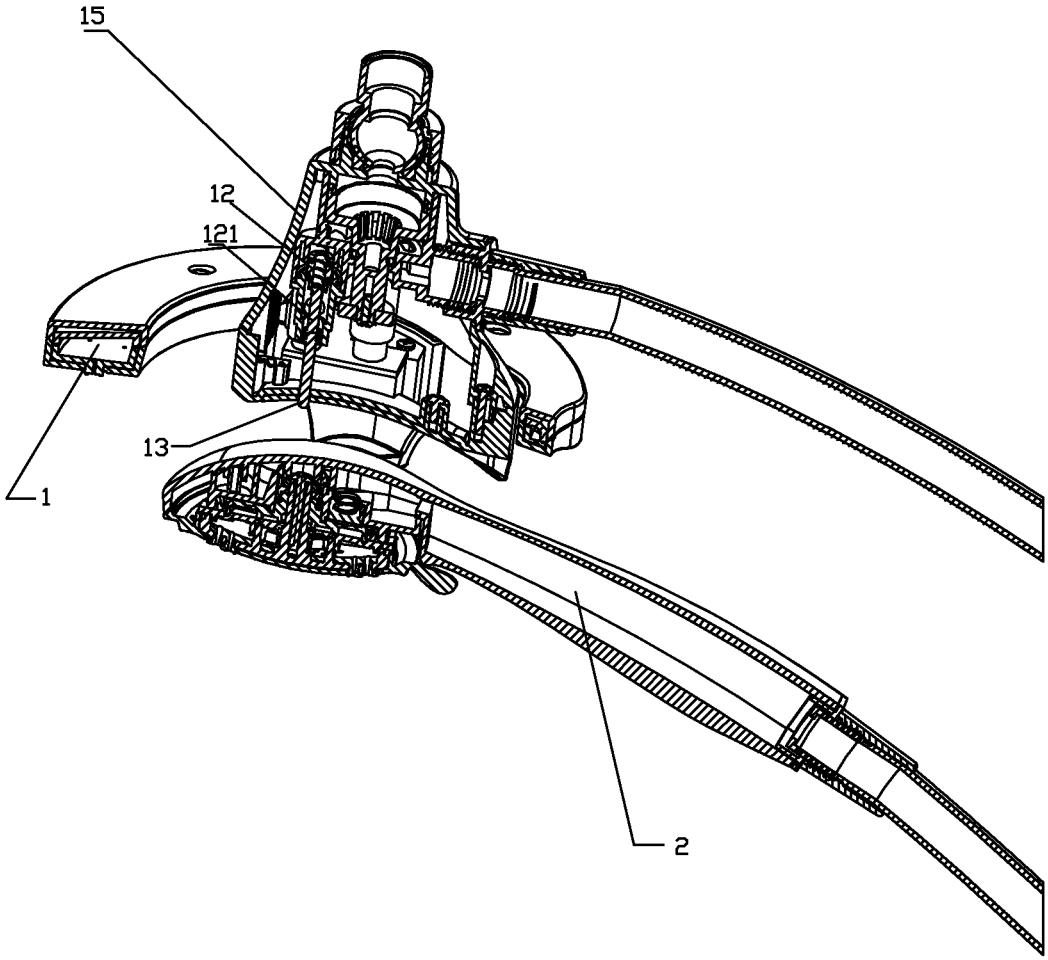
FIG. 11 is a structural profile of the combination shower in the preferred embodiment 2 of the present invention. when the hand-held shower and the head shower is separated.

Referring to FIG. 10-11, the difference between the present embodiment and the embodiment 1 is that: in the embodiment 1, the triggering components 13 and the sealing components 12 are two independent components, it relys on the abutting force between triggering component 13 and sealing component 12 to achieve the role of the trigger component 13 and seal component 12 interlocking. In this embodiment, the trigger component 13 and the water sealing component 12 are two sections of one integral component specifically, in the embodiment 1, the end of the moving shaft 121 abutting with the trigger component extends in the length direction of the moving shaft 121 until one end of the moving shaft 121 is exposed outside the surface of the water inlet component 15 facing the hand shower 2.

This exposed part of the water inlet component 15 facing the outside of the hand shower 2 forms the trigger component, and the structure of the sealing water component 12 is the same as that of the embodiment 1. The back of the hand shower 2 abuts the convex end of the moving shaft 121, and the generated abutting force brings the moving shaft 121 to move in the axial direction of itself. During the movement of the moving shaft 121, the sealing member 12 also moves in the axial direction. The rest of the structure is the same as that of embodiment 1, and will not be repeated here The foregoing is intended to be a preferred embodiment of the present invention, but the scope of the invention is not limited thereto, and any person skilled in the art will be able to easily think of changes within the scope of the invention disclosed. Substitutions are to be covered within the scope of the present invention. Accordingly, the scope of protection of the present invention should be determined by the scope of the claims.

The invention claimed is:

1. A combination shower, comprising:
- a head shower,
- a hand-held shower,
- a first sealing component,
- a trigger component, and
- a gear selection component, wherein:
  - the head shower and the hand-held shower are connected to a first waterway configured to provide water to the hand-held shower or to provide water to the hand-held shower and the head shower concurrently,
  - the head shower is connected to a second waterway configured to provide water to the head shower,
  - the head shower comprises a connecting component that forms a removable fit with the hand-held shower,
  - the first sealing component is drivably connected to the trigger component,
  - the first sealing component is disposed in the first waterway,
  - the gear selection component comprises a second sealing component,
  - the trigger component comprises a swingable block swingably connected to a water inlet component of the head shower,
  - the swingable block comprises a swingable rod and a wedge block,
  - a first end of the swingable rod is swingably disposed in the water inlet component through a rotation shaft,
  - the wedge block is disposed at a second end of the swingable rod and exposed to a side of the water inlet component facing the hand-held shower through a mounting opening of the water inlet component,
  - the first sealing component comprises a movable shaft and a sealing ring arranged outside the movable shaft,
  - a first end of the movable shaft abuts the swingable rod,
  - when the gear selection component is disposed in a first gear position:
    - the second sealing component is disconnected from the second waterway,
    - water flows out of the second waterway,
    - when the hand-held shower is disconnected from the head shower:
      - the first sealing component is in a first position in the first waterway, and
      - the head shower has a first flow volume, and
    - when the hand-held shower is connected to the connecting component to connect the hand-held shower to the head shower:
      - the trigger component is driven by an external force from the hand-held shower to drive the first sealing component to move to a second position in the first waterway, and
      - the head shower has a second flow volume greater than the first flow volume, and
  - when the gear selection component is disposed in a second gear position:
    - the second sealing component is sealed to the second waterway,
    - no water flows out of the second waterway,
    - when the hand-held shower is disconnected from the head shower:
      - the first sealing component is in the first position in the first waterway, and
      - the head shower has a flow volume of zero, and
    - when the hand-held shower is connected to the connecting component to connect the hand-held shower to the head shower:
      - a first abutting force generated between a back of the hand-held shower and the wedge block and causes the swingable rod to swing,
      - a second abutting force between the swingable rod and the movable shaft causes the movable shaft to move along an axis of the movable shaft to cause the first sealing component to move to the second position in the first waterway, and
      - the head shower has a flow volume greater than zero.

2. The combination shower according to the claim 1, wherein:
- the head shower comprises a water outlet component,
- the water inlet component comprises the first waterway and a hand-held shower waterway, and
- the hand-held shower waterway is connected to the hand-held shower through a water outlet hose.

3. The combination shower according to the claim 2, wherein the trigger component and the first sealing component are two different portions of a single integral component.

4. The combination shower according to the claim 1, wherein:
- a second end of the movable shaft is connected to a reset component, and
- when the movable shaft is moved along the axis of the movable shaft to cause the first sealing component to move to the second position:
  - the reset component accumulates an elastic reset force.

5. The combination shower according to the claim 1, wherein:
- a first end of the first waterway is connected to a water inlet,
- the first sealing component is disposed in a second end of the first waterway,
- the first waterway comprises a mounting section,
- a diameter of an inner wall of the mounting section is larger than a diameter of an outer wall of the sealing ring,
- when the movable shaft is moved along the axis of the movable shaft to cause the first sealing component to move to the second position:

the sealing ring moves into the mounting section, and the sealing ring is separated from an inner wall of the first waterway, and when the movable shaft is moved along the axis of the movable shaft to cause the first sealing component to move to the first position:

the sealing ring leaves the mounting section, and the sealing ring is sealed with the inner wall of the first waterway.

6. The combination shower according to the claim 1, wherein:

the connecting component is two clamping blocks spaced apart on the side of the water inlet component facing the hand-held shower, a clamping space for clamping the hand-held shower is defined between the two clamping blocks, and the wedge block is exposed between the two clamping blocks.

7. The combination shower according to the claim 2, wherein:

a first end of the gear selection component is the second sealing component and a second end of the gear selection component is an operating component.

8. The combination shower according to the claim 7, wherein:

when the gear selection component is disposed in the first gear position or the second gear position:

the hand-held shower waterway is fluidly coupled to a water inlet.

9. The combination shower according to the claim 2, wherein:

the trigger component and the first sealing component are two independent components, and the trigger component and the first sealing component are connected to define an interlocking connection.

* * * * *